United States Patent [19]

Dierbeck

[11] Patent Number: 4,938,281

[45] Date of Patent: Jul. 3, 1990

[54] HEAT EXCHANGER WITH MECHANICAL TURBULATOR

[76] Inventor: Robert F. Dierbeck, 2707 Hall Rd., Hartford, Wis. 53027

[21] Appl. No.: 438,709

[22] Filed: Nov. 17, 1989

[51] Int. Cl.[5] ..... F28F 13/12

[52] U.S. Cl. ..... 165/109.1; 165/148

[58] Field of Search ..... 165/109, 148; 123/41.44; 366/144, 262

[56] References Cited

U.S. PATENT DOCUMENTS

| | | | |
|---|---|---|---|
| 2,628,077 | 2/1953 | Handwerk | 165/109.1 |
| 3,348,608 | 10/1967 | Ling et al. | 165/109.1 |
| 3,734,469 | 5/1973 | Goldstein et al. | 165/109.1 |
| 4,832,114 | 5/1989 | Yeh | 165/109.1 |

FOREIGN PATENT DOCUMENTS

| | | | |
|---|---|---|---|
| 1280298 | 12/1986 | U.S.S.R. | 165/109.1 |

*Primary Examiner*—John Rivell
*Assistant Examiner*—L. R. Leo
*Attorney, Agent, or Firm*—Andrus, Sceales, Starke & Sawall

[57] ABSTRACT

A heat exchanger for various kinds of liquid and gaseous fluids includes a tubular conduit having a corrugated heat exchanging outer wall and a series of shaft-mounted turbulator units mounted for rotation within the conduit on the axis thereof. Each of the turbulators diverts a portion of the flow through the tubular conduit and directs it radially outwardly into contact with the heat exchanging wall of the conduit. In a preferred embodiment, the turbulator provides a recirculation of a portion of the fluid flow by directing it in an upstream direction within the turbulator for radial discharge from the upstream end thereof and return downstream flow. The heat exchanger may be used in place of conventional automotive heat exchanging radiator constructions and may utilize welded or unitary constructions that eliminate troublesome soldered construction typical of the prior art. The enhanced heat exchaning capability provided by the present invention allows a substantial reduction in the space required for the heat exchanger, thereby allowing the space to be utilized for other similar heat exchanging apparatus for the same or another fluid.

12 Claims, 4 Drawing Sheets

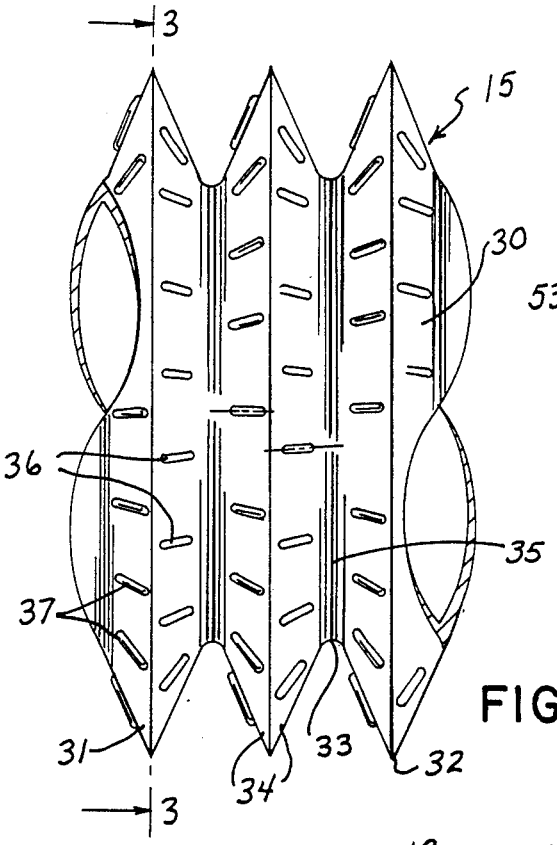
FIG. 2
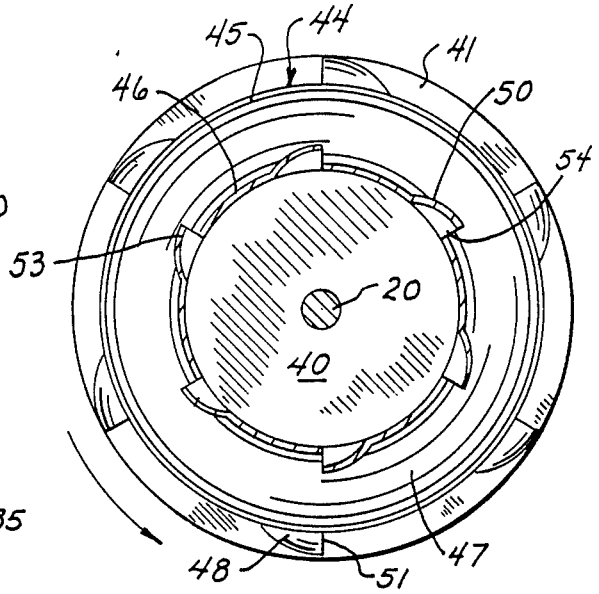
FIG. 5a
FIG. 4
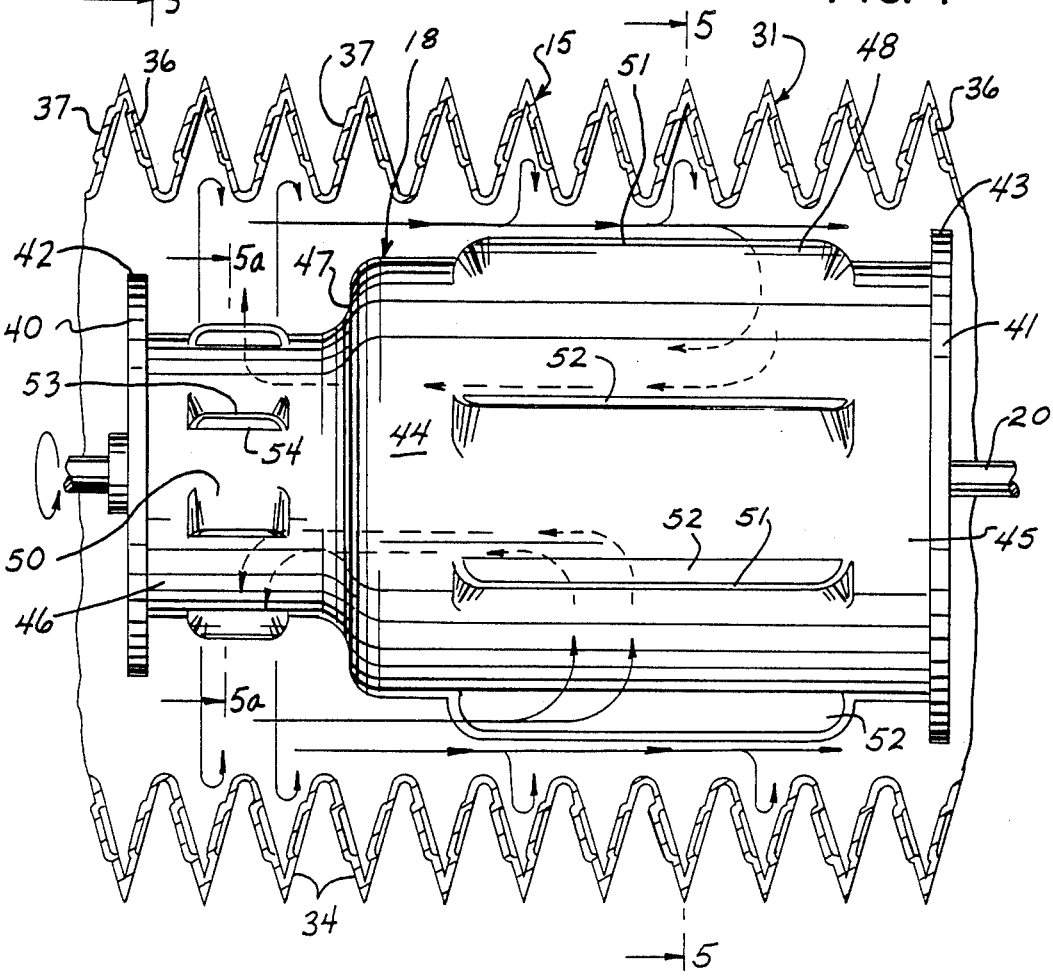

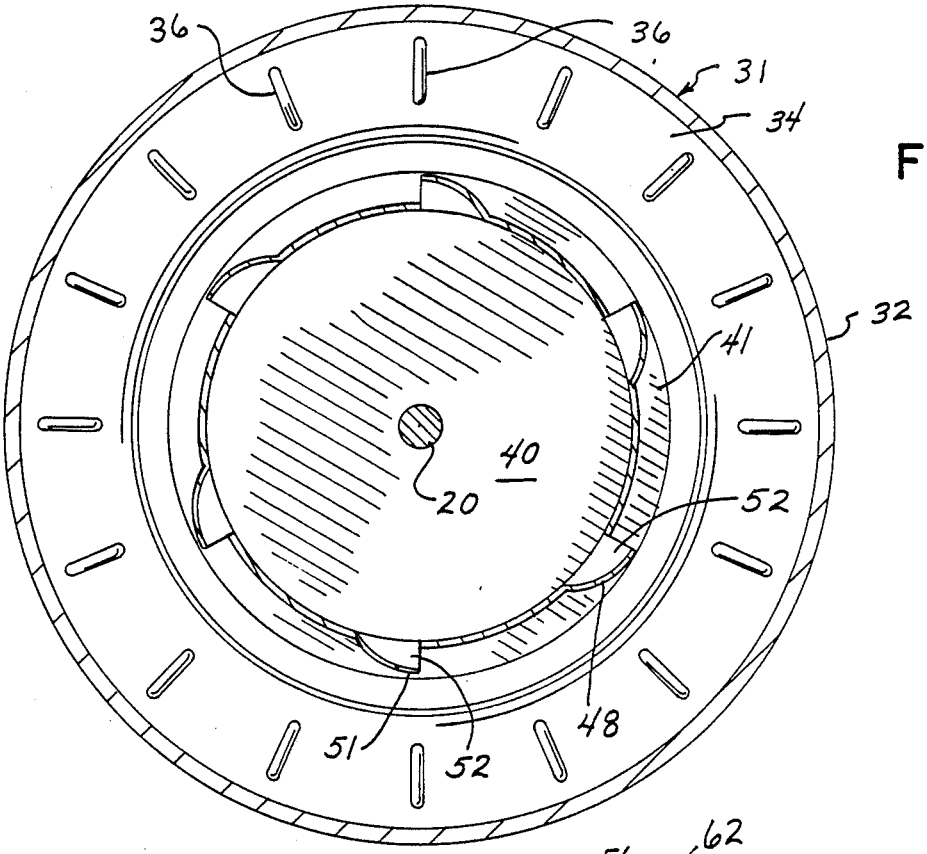
FIG. 5
FIG. 6
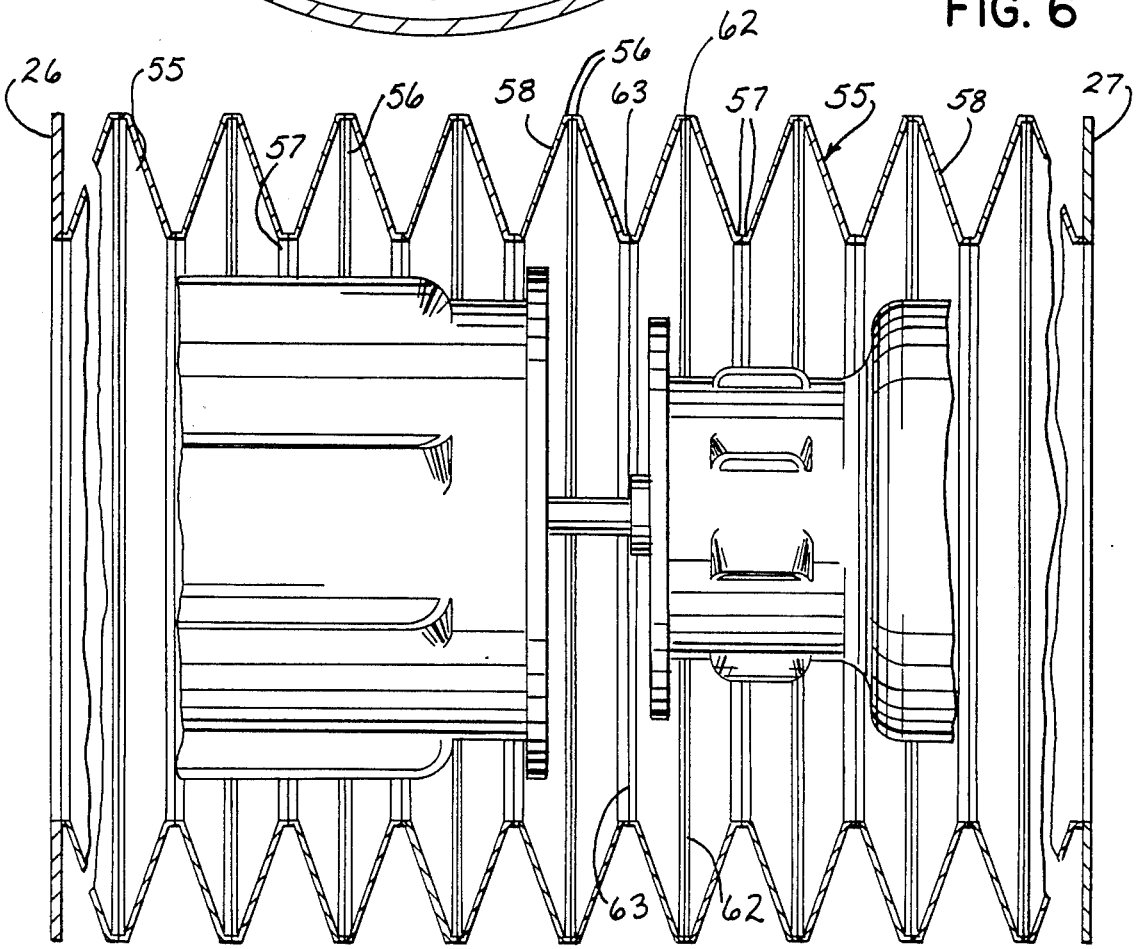

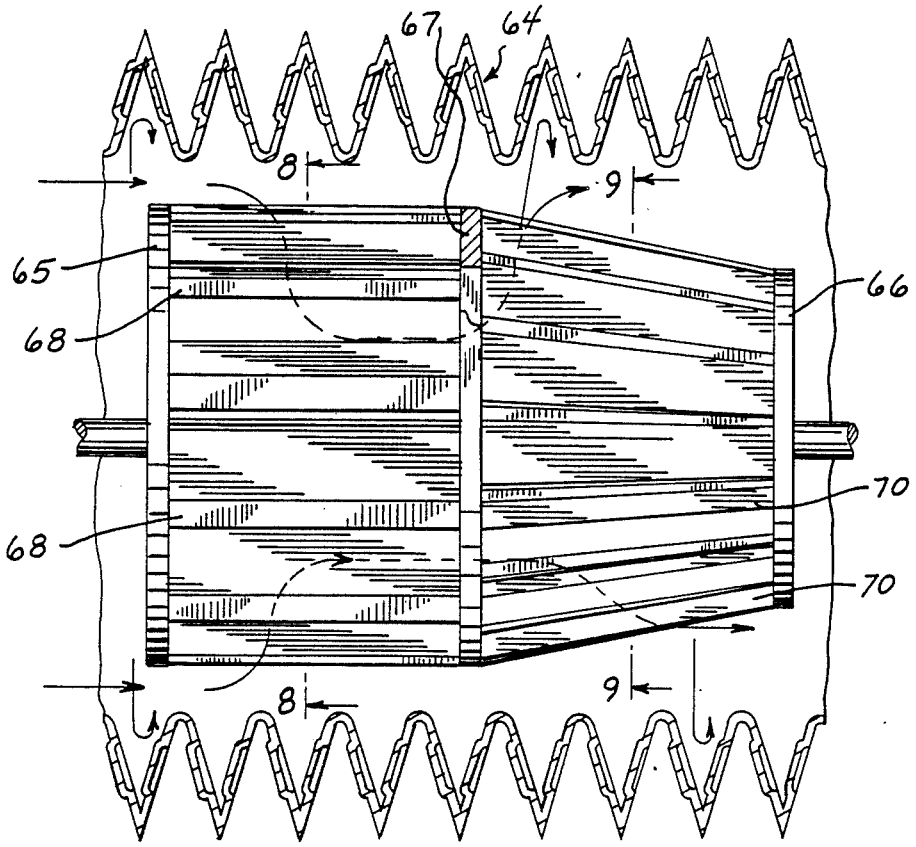
FIG. 7
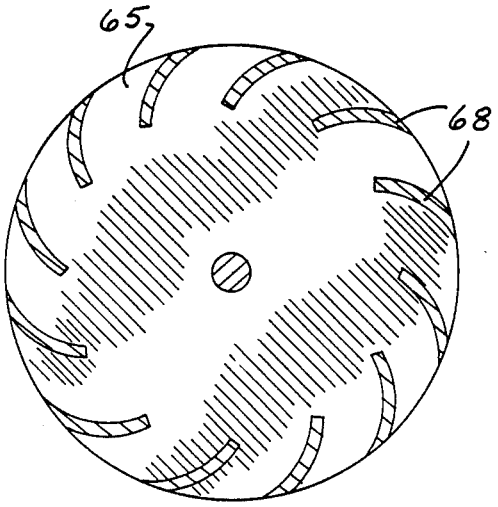
FIG. 8
FIG. 9
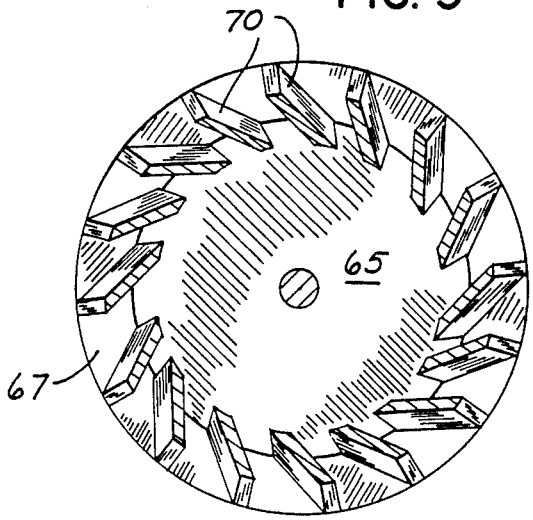

HEAT EXCHANGER WITH MECHANICAL TURBULATOR

Background of the Invention

The present invention pertains to heat exchangers for flowing fluid materials and, more particularly, to a heat exchanger of tubular construction within which a rotating mechanical turbulator enhances the heat exchanging contact between the fluid and the walls of the tubular conduit.

It is known in the prior art to provide the tubular conduits in a heat exchanger through which a gas or liquid material is flowing with stationary or mechanical (moving) turbulators which enhance the mixing of the fluid flowing through the heat exchanger tubes and the contact of the fluid with the walls thereof where heat exchange actually takes place. It is also known to positively drive rotating turbulators from an external power source and such driven mechanical turbulators are intended to provide a high level of heat exchange without substantially increasing the surface area of the heat exchanging conduit. U.S. Pat. No. 3,348,608 shows a shaft-driven turbulator operating within a cylindrical pressure vessel. The turbulator comprises simple shaft-mounted paddles which rotate closely spaced from or in sliding contact with the inside wall of the vessel to enhance the rate of heat exchange between the contents and the vessel.

Soviet Patent No. 1,280,298 shows a series of axially spaced shaft mounted turbulators which are rotatable within a cylindrical conduit. Each of the turbulators includes a series of circumferential blades mounted between a larger open-ended upstream ring and a smaller diameter downstream disk, such that the blades converge in a downstream direction. The fluid flowing in the tubular conduit enters the turbulator through the open upstream end and is directed radially outwardly through the blades against the interior wall of the tube. The convergent orientation of the blades in the direction of flow also imparts a component of movement to the fluid in the downstream direction. The tubular conduit has finned outside walls to enhance heat exchange in a well known manner. However, the flow of fluid past the turbulators and through the conduit in this heat exchanger is much too fast to provide any significant enhancement of the heat exchange.

U.S. Pat. No. 2,628,077 discloses an apparatus for cooling a fluidized bed of solid particulate materials which, like previously identified U.S. Pat. No. 3,348,608, utilizes simple paddles mounted on a driven shaft and rotating within the tubular heat exchanging vessel. The particulate materials are maintained in a fluidized state and heat exchange is not dependent on the creation of turbulence in the fluidized medium.

Soviet Patent No. 966,482 shows a turbulator in which fan-like paddles are mounted on a common shaft which rotates inside a heat exchanging tube. This device is primarily intended for use in cooling gases and the flow of gas through the conduit causes the paddles to rotate.

U.S. Pat. No. 4,832,114 shows a mechanical turbulator which operates in a manner somewhat like that described in the patent identified in the preceding paragraph. However, the turbulator blades are of a substantially different construction and include angled vanes against which the flowing fluid impinges to provide rotation and turbulence in the fluid.

Although all of the devices in the previously described patents add to the turbulence or agitation of a fluid flowing through a heat exchanging conduit, each of the devices does little to impede the flow of the fluid or to cause the fluid to move directly radially outward, both of which factors would enhance the heat exchanging capability substantially. Such enhanced heat exchanging capability would be particularly useful in applications where greater capability is desired or needed but space limitations preclude any substantial increase in the area of the heat exchanging surfaces or the volumes they occupy.

Summary of the Invention

In accordance with the present invention, a heat exchanger for transferring heat to or from a fluid flow includes a tubular conduit having a heat-exchanging outer wall and one or more turbulators which are mounted for rotation within the tubular conduit on a driven shaft which extends through the conduit on its axis. The turbulator includes upstream and downstream end plates, each of which has an outer peripheral edge that is spaced from the outer wall of the conduit to define therebetween a path of restricted fluid flow. Each turbulator includes a pair of axially spaced groups of fluid intake blades and fluid discharge blades which are mounted between the upstream and downstream end plates to define a generally open turbulator interior.

The intake blades are adapted to draw a part of the fluid flow into the interior of the turbulator and the discharge blades to return the fluid flow from the interior of the turbulator radially outwardly toward the outer wall. The intake blades preferably include outer edge portions which are positioned in the path of the restricted fluid flow and oriented in the direction of rotation to sweep a part of the flow radially into the open interior of the turbulator. The discharge blades have outer edge portions which are oppositely oriented with respect to the intake blades and are positioned with respect to the outer wall of the tubular conduit to discharge the fluid from the turbulator interior outwardly against the conduit wall. An external power source is operatively connected to drive the turbulator mounting shaft for operating turbulators. Fluid flow through the conduit is provided by an external pressure source, such as a pump.

In its preferred embodiment, each turbulator comprises a generally cylindrical body which has an enlarged diameter axial end portion in which the fluid intake blades are formed, and a reduced diameter opposite axial end portion in which the fluid discharge blades are formed. The enlarged diameter end portion containing the intake blades is attached to the downstream end plate and the reduced diameter portion containing the discharge blades is attached to the upstream end plate. The blade-containing axial end portions of the turbulator body are separated by a smooth intermediate transition section.

Preferably, the intake blades are formed from a series of circumferentially spaced louvers formed in the turbulator body, each of which includes a fluid intake opening that is open in the direction of rotation of the turbulator. Similarly, the discharge blades comprise a series of circumferentially spaced louvers formed in the turbulator body, each of which defines a fluid discharge opening, but which is open opposite the direction of turbulator rotation. The total area of the intake blade openings is substantially greater than the corresponding area of discharge blade openings.

The upstream end plate has a diameter that is slightly larger than the diameter of the end portion of the turbulator carrying the discharge blades. The downstream end plate has a diameter just slightly larger than the diameter of the end portion of the turbulator body carrying the intake blades and also somewhat larger than the diameter of the upstream end plate.

Also in accordance with the preferred embodiment, the outer wall of the turbular conduit is corrugated and defines axially alternating sections having major and minor diameters. In order to maintain the appropriate spacing between the turbulator and the wall of the tubular conduit, the maximum diameter of the turbulator is less than the minor diameter sections of the corrugated outer wall. In a preferred construction, each of the corrugations in the outer conduit wall comprises a pair of inwardly divergent heat exchanging surfaces. Additionally, the interior of each corrugation may be provided with a directional flow baffle attached to the divergent surfaces defining the corrugation. The baffle preferably comprises a thin plate which is angled radially inwardly in the direction of turbulator rotation to enhance fluid flow through the heat exchanger.

Brief Description of the Drawings

FIG. 2 is an enlarged side elevation of a portion of the tubular conduit including the heat exchanging outer wall construction thereof.

FIG. 4 is an enlarged side elevation, partly in section, showing the preferred construction of the turbulator of the present invention disposed within a tubular conduit of the type shown in FIGS. 2 and 3.

FIGS. 5 and 5*a* are vertical sections taken on lines 5—5 and 5*a*—5*a*, respectively, of FIG. 4.

FIG. 6 is a side elevation similar to FIG. 2, and partly in section, showing a preferred construction for the tubular outer conduit of the present invention.

FIG. 7 is a side elevation of an alternate embodiment of the turbulator.

FIG. 8 is a sectional view taken on line 8—8 of FIG. 7.

FIG. 9 is a sectional view taken on line 9—9 of FIG. 7.

Detailed Description of the Preferred Embodiments

Figure 1:
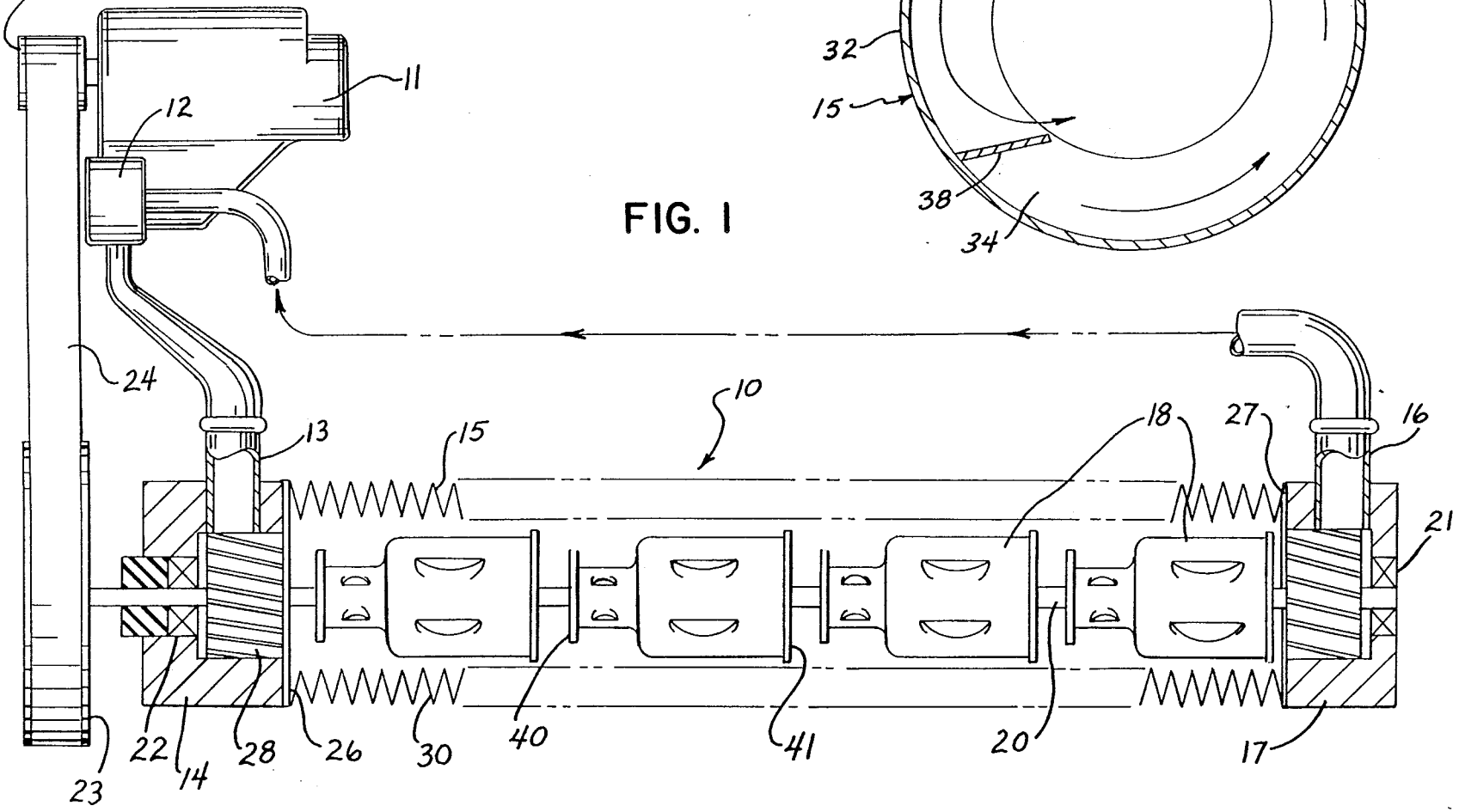
FIG. 1 is an axial cross section through the heat exchanger of the present invention and additionally showing schematically its connection to an engine for the circulation of engine coolant.

Referring initially to FIG. 1, a heat exchanger 10 is shown operatively and somewhat schematically attached to an internal combustion engine 11 for the circulation and cooling of engine coolant. However, the heat exchanger to be described in more detail hereinafter is suited as well for cooling other fluids such as engine oil or engine combustion air, as well as a variety of other fluids used in entirely different applications.

The engine coolant is circulated from the engine 11 by a water pump 12 to the inlet 13 of the heat exchanger 10. The inlet 13 is preferably disposed in an inlet header 14. The heat exchanger includes a tubular conduit 15 through which the fluid flows to an outlet 16 in an outlet header 17 on the opposite end for return flow to the water pump 12. The heat exchanger 10 of the present invention includes both improvements in the heat exchanging surface in the tubular conduit 15 and in a mechanical turbulator 18 or series of turbulators which are mounted for rotation within the tubular conduit 15 to substantially enhance the heat exchanging contact between the fluid and the walls of the tubular conduit 15. Each of the turbulators 18 is mounted on a common driven shaft 20 which is mounted coaxially with the tubular conduit for rotation therein. The shaft extends from a downstream support bearing 21 in the outlet header 17 longitudinally through the tubular conduit and through the inlet header 14 where it is supported by a second bearing 22. The driven shaft 20 extends axially beyond the inlet header 14 and has a driven pulley 23 attached to its end. Pulley 23 is driven by an appropriate belt 24 receiving power from a drive pulley 25 attached the crankshaft of the engine 11.

The opposite ends of the tubular conduit 15 are provided with an inlet flange and an outlet flange 26 and 27, respectively, which may be bolted or otherwise attached directly to the respective inlet header 14 and outlet header 17. The interior of the inlet header 14 may also house an impeller 28 which is mounted on the driven shaft 20 for rotation therewith to supplement the water pump pressure and facilitate the flow of coolant through the heat exchanger. Because the construction of the tubular conduit 15 and the turbulator 18 of the present invention are intended to significantly impede the flow of fluid therethrough to enhance the heat exchanging capabilities, the supplemental impeller 28 may be required.

As shown in FIG. 2, the tubular conduit 15 preferably comprises a corrugated outer wall providing substantially enhanced heat exchanging surface area for the engine coolant or other fluid flowing through the heat exchanger. Each of the corrugations 31 comprises an axially alternating major diameter portion 32 and a minor diameter portion 33. The major diameter portion 32, in turn, is defined by a pair of frustoconical inwardly divergent heat exchanging surfaces 34. The surfaces 34 of adjacent corrugations 31 are joined at their minor diameter portions 33 with an appropriate spacer ring 35 to form the continuous tubular conduit 15. The heat exchanging surfaces 34 and spacer rings 35 may be made of brass, steel, or any other metal which may be suitably stamped and welded. Unlike conventional radiators used as heat exchangers in automotive equipment, the heat exchanger of the present invention requires no soldered seams or joints.

The heat exchanging surface portions 34 may be provided with a series of circumferentially spaced concave indentations 36 or convex protrusions 37. As shown, one surface portion may include concave indentations and the other the convex protrusions. In a varient construction, each heat exchanging surface 34 may be provided with a circumferentially varying series of indentations and protrusions. The purpose of the indentations and protrusions is to provide enhanced heat exchanging surface area and to provide irregularities in the internal surface of the tubular conduit to increase the turbulence and thus the contact of the liquid or other fluid and the conduit walls.

Figure 3:
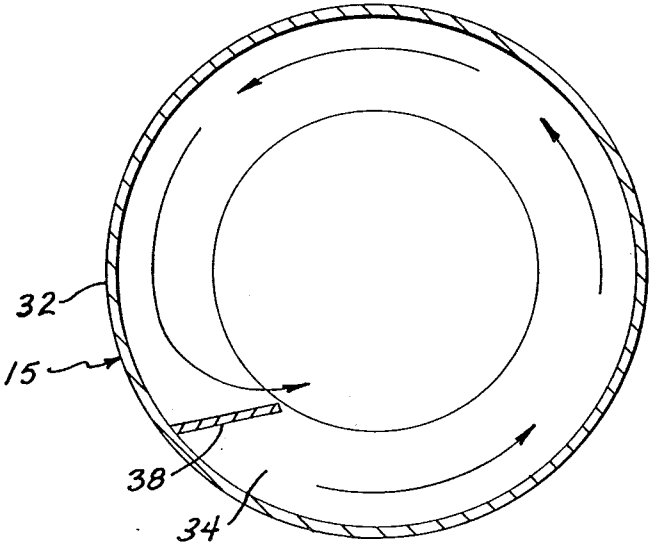
FIG. 3 is a vertical section taken on line 3—3 of FIG. 2.

Each of the corrugations 31 may be provided internally with a directional flow baffle 38, as best shown in FIG. 3. Each baffle 38 comprises a thin plate welded or otherwise attached to the interior of the heat exchanging surfaces 34 and angled radially inwardly in the direction of rotation of the turbulator or turbulators 18. As will be explained in greater detail hereinafter, the flow baffle helps to return the flow of liquid radially inwardly which has been previously moved radially outwardly into the corrugations by the action of the turbulator.

FIGS. 4, 5 and 5a show details of the construction of the turbulator 18 of the preferred embodiment. Each turbulator includes an upstream end plate 40 and a downstream end plate 41, each of which comprises a cicular disk having an outer peripheral edge 42 and 43, respectively, spaced slightly from the interior surface of the outer wall of the tubular conduit 15. In the tubular conduit having a corrugated wall 30, the end plates 40 and 41 have diameters which are less than the minor diameter portions 33 of the conduit, so as to fit conveniently for rotation therein. The turbulator 18 includes a generally cylindrical body 44 which has an enlarged diameter downstream end portion 45 and a reduced diameter upstream end portion 46 which are connected by an integral smooth intermediate transition section 47. The cylindrical body 44 may be made of suitably drawn tubular steel or molded of a high temperature resistant plastic material. The turbulator body 44 defines a generally open interior which is closed at its opposite axial ends by the upstream and downstream end plates 40 and 41, respectively, and through which the driven shaft 20 extends along the axis thereof. The end plates 40,41 are substantially solid, except for appropriate openings for the passage of the driven shaft 20, and include suitable connectors at the shaft openings for rigidly securing the turbulator to the shaft.

The larger diameter downstream end portion 45 of the turbulator body is provided with a series of axially extending and circumferentially spaced intake blades 48 which are positioned to sweep a portion of the fluid flowing through the tubular conduit radially into the open interior of the turbulator body. The upstream end portion 46 of the turbulator body 44 is provided with a series of axially extending and circumferentially spaced discharge blades 50 which are oppositely oriented with respect to the intake blades and positioned to discharge fluid from the interior of the turbulator and direct it radially outwardly towards the inner surface of the conduit wall 30.

In the preferred embodiment of the turbulator shown in FIGS. 4 and 5, the intake blades 48 comprise a series of louvers 51 having an intake opening 52 which is open in the direction of rotation of the turbulator. Similarly, the discharge blades each comprise a discharge louver 53 having a fluid discharge opening 54 which opens opposite the direction of rotation of the turbulator. With the turbulator 18 disposed in the tubular conduit 15, the outer peripheral edges of the intake louvers 51 and the slightly larger diameter outer edge 43 of the downstream end plate 41 define with the adjacent minor diameter portions 33 of the corrugated wall a path of restricted fluid flow. As the fluid, such as engine coolant, flows into this narrow region of restricted flow, a portion of the flow will be directed radially by the rotation of the turbulator into the adjacent corrugations 31 and into contact with the heat exchanging surfaces 34. Another portion of the fluid flow will continue in a downstream direction and be swept into the intake openings 52 of the intake louvers 51, and the final portion of the total flow will continue in a downstream direction to the next turbulator or to the heat exchanger outlet 16. The various arrows in FIG. 4 show the manner in which the total flow past the turbulator is split. The portion of the flow swept into the interior of the turbulator body 44 through the intake louvers 51 is forced to flow in an upstream direction counter to the main flow into the smaller diameter upstream end portion 46 and out of the discharge openings 54 in the discharge louvers 53. Because the total area of the intake openings 52 is substantially larger than the total area of the discharge openings 54, the flow velocity of the fluid discharged from the discharge louvers will be increased and will assist in forcing a portion of the flow radially outward and into the corrugations 31 adjacent the discharge louvers, as also indicated by the flow arrows. The radial discharge from the discharge louvers will, of course, also mix with a portion of the main flow to the turbulator past the upstream end plate 40. Thus, the turbulator of the preferred embodiment provides a two stage heat transfer with at least a portion of flow being recirculated through the turbulator. The speed of rotation of the turbulator driven shaft 20 may be reduced in comparison to turbulator constructions in which the flow is primarily or only in a generally downstream direction.

In FIG. 6, there is shown a preferred construction of a tubular conduit 15 for a heat exchanger in which there is mounted a turbulator of the type shown in FIGS. 4 and 5. The tubular conduit 15 is fabricated from a series of shallow open ended dish-shaped disks 55. Each disk 55 is defined by an outer diameter flange 56 and an inner diameter flange 57 interconnected by a frustoconical surface 58. Each surface 58 may be provided with a series of circumferentially spaced alternating concave indentations and convex protrusions, in a manner similar to the indentations 36 and protrusions 37 of the FIG. 2 embodiment. The disks 55 are stacked in an alternating reversed orientation and welded along O.D. seams 62 and I.D. seams 63 to provide a corrugated tubular conduit. The turbulator 18, such as one identical to that shown in FIGS. 4 and 5, or a series of such turbulators, is mounted on a driven shaft 20 and disposed axially in the tubular conduit with the maximum outer diameter of the turbulator (as defined by the outer edge 43 of its downstream end plate 41) spaced slightly from the seamed I.D. flanges 57 to provide a path of restricted fluid flow, as previously described.

The concave indentations 60 and convex protrusions 61 provide the same increased heat exchanging surface area and enhanced turbulence to the fluid flow, also as previously described. In addition, a flow baffle 38 (FIG. 3) may be appropriately placed and fastened within the space between opposed frustoconical surfaces 58 of interconnected disks 55.

FIGS. 7–9 show an alternate embodiment of a turbulator 64 which provides only a single pass of the fluid therethrough. The turbulator 64 may be mounted within a tubular conduit 15 of either of the types previously described and on a driven shaft 20 also in a similar manner. The turbulator includes a larger diameter upstream end plate 65, a smaller diameter downstream end plate 66, and an intermediate open spacer ring 67. A series of intake blades 68 are mounted between the upstream end plate 65 and the spacer ring 67. The intake blades 68 may have curved surfaces, as shown in FIG. 8, and are oriented such that the outer edges point in the direction of turbulator rotation to sweep water into the interior thereof. A series of circumferentially spaced discharge blades 70 are attached between the spacer ring 67 and the downstream end plate 66. The discharge blades may be of a generally flat construction and, as shown in FIG. 9, are oriented opposite the direction of turbulator rotation. A portion of the liquid coolant or other fluid being pumped through the tubular conduit 15 is picked up by the upstream intake blades 68 and swept into the interior of the turbulator. As indicated by the arrows, the portion of the flow picked up by the intake blades passes through the open spacer ring 67 and is discharged radially outward past the discharge blades 70. The radial discharge past the discharge blade 70 forces a portion of the flow into the corrugations 31 in the tubular conduit, as previously described. Also as shown in FIG. 7, the discharge blade 70 may be angled to converge in a downstream direction to provide a downstream component to the flow discharge therefrom. In this case, the downstream end plate 66 may be of somewhat smaller diameter than the upstream end plate 65 and the spacer ring 67.

The heat exchanger including the mechanical turbulator of the present invention is adaptable to a wide range of applications in both over the road vehicles and off road equipment, as well as other applications. The entire heat exchanger assembly, including the tubular conduit 15 and turbulator 18 can be made of materials and constructions which are heavier and more durable than, for example, conventional radiators for vehicles and similar equipment. The tubular conduit 15 may be made of a welded metal construction which completely eliminates the soldered joints and seams typically used in conventional radiator constructions. The turbulator body 44 of the preferred embodiment may be made of a drawn tubular steel construction or molded of a suitable high temperature plastic.

The substantially enhanced heat exchanging capability of the heat exchanger of the present invention allows a reduction in the size and volume occupied by a conventional radiator and, as a result, provides the possibility of greater heat exchanging capability in-the space provided or the capability of providing cooling of other system fluids without increasing the space requirements. For example, in addition to providing heat exchanging capability for engine coolant, substantially similar parallel systems could also be provided for cooling engine oil and for cooling engine combustion air, all in a space no greater than that typically occupied by a conventional radiator. It is also possible, utilizing tubular conduits 15 having corrugated walls, as shown in the different embodiments herein, to nest the tubular conduits to save space and to also accelerate the flow of cooling air past the outside surfaces of the conduits for further enhanced heat exchange.

Various modes of carrying out the present invention are contemplated as being within the scope of the following claims particularly pointing out and distinctly claiming the subject matter which is regarded as this invention.

I claim:

1. A heat exchanger for a fluid flow comprising:

a tubular conduit having a heat exchanging outer wall, an inlet end and an outlet end for the flow of a fluid therethrough;

a rotatable turbulator mounted for rotation within the tubular conduit on a driven shaft, said shaft extending through said conduit on an axis thereof;

said turbulator including an upstream end plate and a downstream end plate, each having an outer peripheral edge spaced from the outer wall of the conduit to define therebetween a path of restricted fluid flow;

said turbulator further including axially spaced groups of fluid intake blades and fluid discharge blades mounted between the upstream and downstream end plates and defining therewith a generally open interior;

said intake blades having outer edge portions positioned in the path of restricted fluid flow and oriented to sweep a part of the fluid flow radially into the open interior of the turbulator;

said discharge blades having outer edge portions oppositely oriented with respect to said intake blades and positioned with respect to the outer wall of said conduit to discharge fluid from said open interior radially outwardly toward said outer wall; and, means for rotating said driven shaft and for causing the fluid to flow through said conduit.

2. The apparatus as set forth in claim 1 wherein said turbulator further comprises a generally cylindrical body having an enlarged diameter axial end portion containing said fluid intake blades and a reduced diameter opposite axial end portion containing said fluid discharge blades.

3. The apparatus as set forth in claim 2 wherein the enlarged diameter end portion of the body is attached to the downstream end plate and the reduced diameter end portion is attached to the upstream end plate.

4. The apparatus as set forth in claim 3 wherein said body includes a smooth intermediate transition section between said enlarged and reduced diameter end portions.

5. The apparatus as set forth in claim 3 wherein said intake blades comprise a series of circumferentially spaced louvers each having a fluid intake opening which is open in the direction of rotation of the turbulator.

6. The apparatus as set forth in claim 5 wherein said discharge blades comprise a series of circumferentialy spaced louvers each having a fluid discharge opening which is open opposite said direction of rotation.

7. The apparatus as set forth in claim 6 wherein the total area of said intake openings is substantially greater than the total area of said discharge openings.

8. The apparatus as set forth in claim 7 wherein the upstream end plate has a diameter slighty larger than the diameter of said reduced diameter end portion and the downstream end plate has a diameter slightly larger than the diameter of said enlarged diameter end portion and larger than the diameter of said upstream end plate.

9. The apparatus as set forth in claim 1 wherein the outer wall of said tubulator conduit is corrugated and defines axially alternating major and minor diameter sections.

10. The apparatus as set forth in claim 9 wherein the maximum diameter of said turbulator is less than the minor diameter of said corrugated outer wall.

11. The apparatus as set forth in claim 10 wherein each of the corrugations in the outer wall of said conduit comprises a pair of inwardly divergent heat exchanging surfaces.

12. The apparatus as set forth in claim 11 including a direction flow baffle in the interior of each corrugation and attached to the surfaces thereof, said baffle comprising a thin plate angled radially inwardly in the direction of turbulator rotation.

* * * * *